US008556600B2

(12) United States Patent
Grynning et al.

(10) Patent No.: US 8,556,600 B2
(45) Date of Patent: Oct. 15, 2013

(54) PROTECTION SYSTEM FOR SUBSEA SEAWATER INJECTION PUMPS

(75) Inventors: Audun Grynning, Stabekk (NO); Stein Vegar Larsen, Lier (NO); Geir Inge Olsen, Oslo (NO)

(73) Assignee: Aker Subsea AS, Lysaker (NO)

( * ) Notice: Subject to any disclaimer, the term of this patent is extended or adjusted under 35 U.S.C. 154(b) by 528 days.

(21) Appl. No.: 12/681,873

(22) PCT Filed: Oct. 7, 2008

(86) PCT No.: PCT/NO2008/000356

§ 371 (c)(1),
(2), (4) Date: Apr. 15, 2010

(87) PCT Pub. No.: WO2009/048336

PCT Pub. Date: Apr. 16, 2009

(65) Prior Publication Data

US 2010/0239442 A1 Sep. 23, 2010

(30) Foreign Application Priority Data

Oct. 9, 2007 (NO) ..... 20075118

(51) Int. Cl.
*F04B 17/00* (2006.01)
*F04B 35/04* (2006.01)

(52) U.S. Cl.
USPC ..... 417/423.3; 417/423.7; 417/423.8; 417/423.11; 310/83

(58) Field of Classification Search
USPC ..... 417/423.3, 423.7, 423.11, 278, 279; 310/87
See application file for complete search history.

(56) References Cited

U.S. PATENT DOCUMENTS

| | | | | | |
|---|---|---|---|---|---|
| 3,468,259 | A | | 9/1969 | Morzynski et al. | |
| 3,984,715 | A | * | 10/1976 | Kullmann et al. | 310/219 |
| 4,197,488 | A | * | 4/1980 | Kant | 318/115 |
| 4,487,299 | A | * | 12/1984 | Bookout | 188/313 |
| 5,101,128 | A | * | 3/1992 | Veronesi et al. | 310/54 |
| 5,417,544 | A | * | 5/1995 | Mohn | 415/64 |

(Continued)

FOREIGN PATENT DOCUMENTS

| | | |
|---|---|---|
| DE | 12 93 390 B | 4/1969 |
| GB | 1218023 A | 1/1971 |

(Continued)

OTHER PUBLICATIONS

De Martino, Marcello, "International Search Report", for PCT/NO2008/000356 as mailed Feb. 24, 2009, 3 pages.

*Primary Examiner* — Charles Freay
*Assistant Examiner* — Ryan Gatzemeyer
(74) *Attorney, Agent, or Firm* — Winstead PC.

(57) ABSTRACT

This invention relates to a pump system, especially for boosting the flow rate of a fluid through a pipe (1, 2, 6), comprising a pump positioned in a pump chamber (10) for pumping at a chosen rate, and a motor driving said pump, the motor being positioned in a chamber (9) being provided with a pressurized fluid, the pressure of which being higher than the pressure in the pump chamber, the motor and the pump chambers being separated by a seal (8), the seal allowing a leakage of said pressurized fluid between them, wherein the pressurized fluid is acceptable to the pump environment and the system comprises a discharge branch line (3) coupled to the pipe(6) and positioned downstream from said pump, the discharge branch line having an outlet into the environment.

10 Claims, 2 Drawing Sheets

(56) References Cited

U.S. PATENT DOCUMENTS

| | | | | |
|---|---|---|---|---|
| 5,549,447 | A * | 8/1996 | Bevington | 415/115 |
| 5,899,220 | A * | 5/1999 | Alcocer et al. | 137/13 |
| 6,100,616 | A * | 8/2000 | Heinig et al. | 310/87 |
| 6,447,245 | B1 | 9/2002 | Oakley et al. | |
| 6,666,664 | B2 * | 12/2003 | Gross | 417/423.3 |
| 6,688,860 | B2 * | 2/2004 | Du et al. | 417/423.11 |
| 6,981,853 | B2 * | 1/2006 | Du et al. | 417/414 |
| 7,217,107 | B2 * | 5/2007 | Du et al. | 417/414 |
| 7,654,315 | B2 * | 2/2010 | Du et al. | 166/105 |
| 7,741,744 | B2 * | 6/2010 | Watson et al. | 310/87 |
| 7,806,670 | B2 * | 10/2010 | Du et al. | 417/414 |
| 7,887,307 | B2 * | 2/2011 | Laing | 417/423.8 |
| 8,221,092 | B2 * | 7/2012 | Chilcoat et al. | 417/53 |
| 8,226,385 | B2 * | 7/2012 | Wendel et al. | 417/423.8 |
| 8,303,268 | B2 * | 11/2012 | Werson et al. | 417/366 |
| 2001/0014290 | A1 * | 8/2001 | Takura et al. | 417/371 |
| 2001/0043871 | A1 * | 11/2001 | Rennett et al. | 417/368 |
| 2002/0114714 | A1 * | 8/2002 | Sato et al. | 417/373 |
| 2002/0155003 | A1 * | 10/2002 | Zupanick et al. | 417/53 |
| 2004/0028539 | A1 * | 2/2004 | Williams et al. | 417/366 |
| 2005/0053494 | A1 * | 3/2005 | Andrews | 417/423.8 |
| 2005/0167096 | A1 | 8/2005 | Du et al. | |
| 2005/0214141 | A1 * | 9/2005 | Huster et al. | 417/423.8 |
| 2006/0157251 | A1 * | 7/2006 | Stinessen et al. | 166/357 |
| 2007/0140876 | A1 * | 6/2007 | Parmeter et al. | 417/423.11 |
| 2007/0277969 | A1 * | 12/2007 | Hall et al. | 166/105 |
| 2008/0197718 | A1 * | 8/2008 | Wohner | 310/11 |
| 2008/0260539 | A1 * | 10/2008 | Stinessen et al. | 417/26 |
| 2009/0134719 | A1 * | 5/2009 | Tomsic | 310/11 |
| 2009/0324436 | A1 * | 12/2009 | Wendel et al. | 417/423.8 |
| 2010/0129237 | A1 * | 5/2010 | Eide et al. | 417/410.1 |

FOREIGN PATENT DOCUMENTS

| | | | |
|---|---|---|---|
| JP | 2002 327696 | A | 11/2002 |
| WO | WO-01/25634 | A1 | 4/2001 |
| WO | WO-03/071139 | A1 | 8/2003 |
| WO | WO-2005/003512 | A1 | 1/2005 |
| WO | WO-2007/043889 | A1 | 4/2007 |
| WO | WO-2007/055589 | A1 | 5/2007 |

* cited by examiner

PROTECTION SYSTEM FOR SUBSEA SEAWATER INJECTION PUMPS

Pumps will typically have to be operated above a minimum flow rate in order to avoid creating unstable behaviour, overheating and consequently pump breakdown. In order to obtain this protection of the pump at low flow demands, a minimum flow arrangement is included. Such arrangement will typically include routing flow back from the outlet to the inlet through a throttling device. Such by-pass can be active continuously or enabled by a valve activated at low flow or high pressure at the outlet. A centrifugal pump applied for subsea raw sea water injection can have a minimum flow arrangement of the same kind as typically used topsides.

A subsea pumping system is designed to move fluid, i.e. liquid and/or gas from one location to another. This may be achieved by using a pump. Common for all processes that involve moving of fluids is that the process requires added energy. This energy is typically added by using some kind of motor and fed to the pump through a shaft, e.g. in centrifugal pumps and rotodynamic pumps as described in GB1218023, U.S. Pat. No. 3,468,259 and U.S. Pat. No. 6,447,245. Such a solution therefore requires some kind of shaft sealing system. The objective of the shaft sealing system is to prevent mixing of the fluids inside the motor and in the pump. Since intrusion of seawater may cause degradation or destruction of the motor internals, especially in the case where the motor is electric, an over-pressure is applied in the motor. The higher pressure in the motor will cause a leakage across the shaft seal from the motor to the pump, preventing ingress of fluid from the pump to the motor. Therefore, the leaking motor fluid will mix with the seawater flowing through the pump.

Pumps have a limited operating envelope with regards to flow and head, i.e. a certain minimum amount of liquid must flow through the pump at all times to avoid overheating and excessive vibrations. To stay within the operating envelope during any mode of operation, a pump protection system is necessary, ensuring a certain minimum amount of flow through the pump. A typical arrangement of such a minimum flow arrangement is shown in FIG. 1.

Also, the flow through the pump will be contaminated by the leaking fluid from the motor across the shaft sealing system. This may pose a problem because of restrictions in the leakages into the environment and may require cleaning of the pumped fluids or reduction of the leaks. It is therefore an object of the present invention to simplify the pump protection system needed in subsea pumping systems, and also reduce the contaminations in the pumped fluid.

The present invention obtain these objects by providing a simpler pump protection system compared with the traditional recirculation system for a pump system designed for boosting seawater to an injection well or for other purposes. This is obtain by using a pump system as described above and specified as stated in the independent claim.

The invention is thus based on the concept of using an environmental friendly fluid in the motor. Environmentally friendly fluids being defined as fluids being allowed by existing regulations, e.g. being non-toxic in the environment it is introduced. By using a fluid in the motor that is acceptable to the pump environment, the fluid flow can be dumped into the environment without causing any threat. The invention also provides a system where the pump is used within the optimal range of flow rates as the pumped fluid as well as the pressurized fluids leaked from the motor may be circulated back into the surroundings without polluting the environment. Thus improved protection for the pump is obtained.

The invention will be described below with reference to the accompanying drawings, illustrating the invention by way of example.

Figure 1:
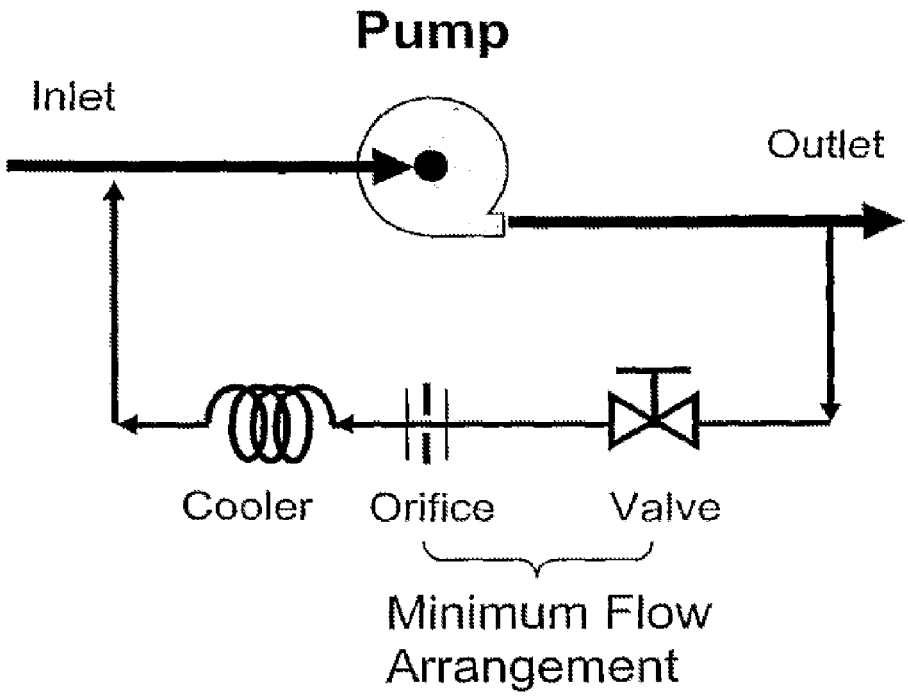
FIGURE 1 (PRIOR ART)
FIG. 1 illustrates a typical minimum flow arrangement according to the known art.

Current subsea pumping systems utilize conventional electric motors with windings that have connections that are not fully insulated towards the environment, filled with dielectric oil where said oil act as an additional insulator. According to environmental rules and regulations, emission of such dielectric oil to the environment is not allowed. For systems utilizing such fluids, a closed minimum flow loop for pump protection must be used as indicated in FIG. 1.

In a closed loop, where the same water is being recirculated, the energy added by the pump into the fluid would cause the fluid, and hence the pump, to overheat and finally cause breakdown. The closed loop solution therefore requires an orifice/choking device, piping and valves to form the closed loop, and a cooler to avoid overheating of the re-circulating fluid in the closed loop.

The present invention as explained in the following will significantly reduce the size and number of components necessary, ultimately leading to lower cost, weight and complexity of a subsea pumping system.

Figure 2:
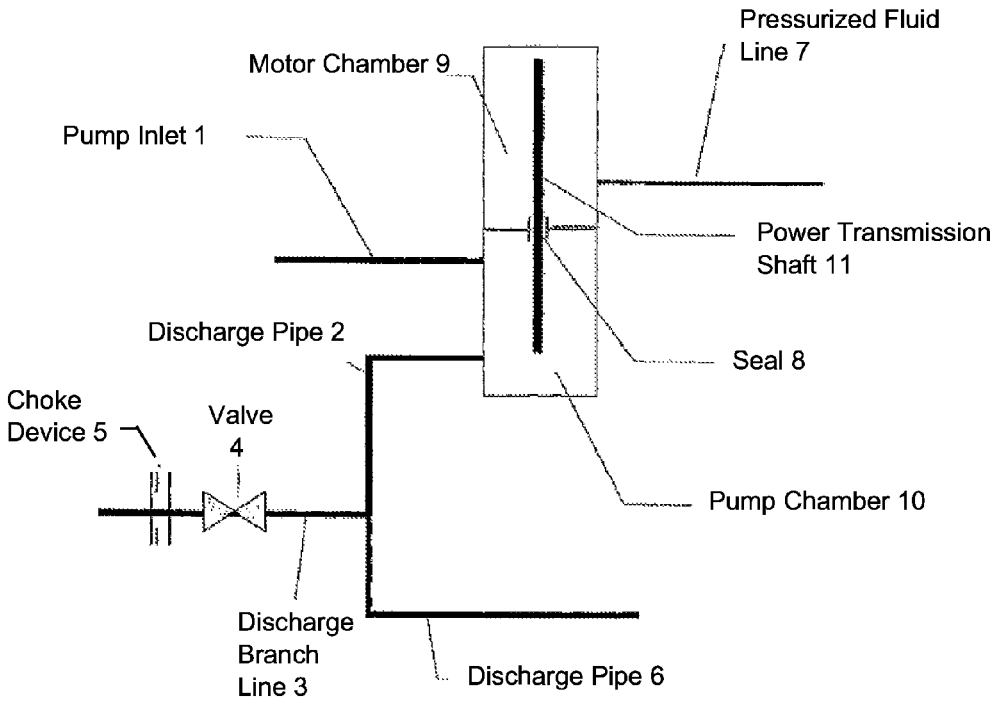
FIG. 2 illustrates the system according to the invention

Referring to FIG. 2 the pump unit (8,9,10,11) generates a flow from the pump inlet (1) to the discharge pipe/line (2,6). The receiving reservoir has a flow/head characteristic. If the resistance of the receiving reservoir is outside the pump operating envelope, sufficient flow through the discharge pipe (6) can not be established. The system must therefore ensure continued operation by establishing a flow through a discharge branch line (3) positioned downstream the outlet from said pump and being separated from the pump by a fluid conduit (2). According to the preferred embodiment of the invention the discharge branch line is controlled by opening the valve (4) causing the discharge flow to be routed directly to sea through a choking device (5). The choking device (5) may be a part of the valve (4) itself or be a separate choking device upstream or downstream a valve without choking function. The choking device (5) is designed so that when the valve (4) is open, the pump is ensured sufficient flow regardless of resistance of the receiving reservoir (closed valve or other cause of high resistance in the discharge pipe (6).

The system incorporates a measuring or control system which in a per se known way monitors the conditions in the discharge pipe and possibly other conditions therein, and controls both pump speed and valves in order to maintain the pump in the optimum operation range. This may also be performed by automatic opening of the valves at a chosen motor resistance or other pump protection methods.

Routing of pump discharge fluid directly to sea as described herein is only possible, i.e. allowed, if said fluid is environmentally friendly. This is ensured by the arrangement described below.

According to the preferred embodiment of the invention the pump unit includes a motor chamber (9), preferably containing an electrical motor, which is separated from the pump chamber(s) (10) by the use of a sealing system (8) through which the shaft or power transmission (11) from the motor to the pump is lead. The motor chamber (9) is separated from the pump chamber (10) containing a pump, e.g. a centrifugal pump, using one or several additional chambers. The motor chamber (9) is fed by a pressurized, environmental friendly seal fluid, i.e. a fluid that is acceptable to the pumped medium and the environment, through a line (7) from a supply either located subsea or topside. The motor fluid supply, typically made up by a mixture of water and glycol (or other ingredients that ensure sufficient corrosion resistance), shall ensure a higher pressure in the motor chamber (9) than in the pump (10) to prevent ingress of seawater into the motor (9). The sealing system (8) is made to prevent exchange of fluid between the chambers but will not entirely seal the chambers. The higher pressure in the motor will therefore cause a leakage through the seal system (8). The leakage of the motor fluid will mix with the seawater coming from the pump inlet (1).

This way it is possible to secure a minimum flow through a raw sea water injection pump by circulation, at least a portion of the total flow back to sea though a remote controlled valve. Flow back into the sea is obtained through a discharge branch line preferably including a valve, e.g. a choke, which may be controlled topside, involve local pressure sensor etc for controlling the flow. The valve can be combined with a fixed orifice for providing improved control of the flow. As stated above the circulation to sea can be done in an environmentally friendly way due to using environmental friendly fluid as barrier fluid and cooling fluid in the motor. In order to avoid electrical conduction through the pressurized fluid in the motor the electric motor has fully insulated winding, thus making it possible to accept water based environmentally friendly fluid as cooling fluid.

The present invention is mainly aimed at the purpose of injecting sea water into a well using a rotodynamic or positive displacement pump driven by an electric motor, but other uses, e.g. involving an hydraulic motor, may be contemplated. The orifice and valve may be chosen from any available types suitable for the specific use. As is evident from the discussions above it is also important that the pumped fluid is acceptable to the environment as it is discharged into the environment when the pressure in the discharge pipe is too high.

The invention claimed is:

1. A pump system, comprising:

a pump positioned in a pump chamber for pumping seawater at a chosen rate into a discharge pipe;

an electric motor comprising insulated windings driving the pump, the electric motor positioned in a motor chamber;

a pressurized fluid provided to the motor chamber and the pressurized fluid disposed inside of the electric motor, wherein the pressurized fluid is water based and acceptable to a seawater environment;

a seal separating the motor chamber and the pump chamber, wherein the seal allows a leakage of the pressurized fluid between the motor chamber and the pump chamber; and a discharge branch line coupled to the discharge pipe and positioned downstream from the pump, the discharge branch line having an outlet to the seawater environment, whereby the pressurized fluid leakage can be circulated to the seawater environment.

2. The pump system according to claim 1, wherein the pressurized fluid in the motor is a cooling fluid for cooling the motor.

3. The pump system according to claim 1, wherein the discharge branch line comprises a valve for regulating the flow therethrough.

4. The pump system according to claim 3, wherein the valve is a choke.

5. The pump system according to claim 3, wherein the discharge branch line comprises an orifice for limiting the flow rate to a chosen rate.

6. The pump system according to claim 1, wherein the pressurized fluid is a mixture of water and glycol.

7. The pump system according to claim 1, comprising a control system for monitoring a pump resistance and controlling the flow through the discharge branch line so as to maintain the pump rate at a chosen minimum rate.

8. The pump system according to claim 1, further comprising a pump inlet providing seawater from the seawater environment into the pump chamber.

9. The pump system according to claim 1, comprising a power transmission shaft connecting the motor to the pump, wherein power transmission shaft extends through the seal.

10. The pump system according to claim 9, further comprising a pump inlet providing seawater from the seawater environment into the pump chamber.

* * * * *

UNITED STATES PATENT AND TRADEMARK OFFICE

CERTIFICATE OF CORRECTION

PATENT NO. : 8,556,600 B2
APPLICATION NO. : 12/681873
DATED : October 15, 2013
INVENTOR(S) : Grynning et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 519 days.

Signed and Sealed this
Fifteenth Day of September, 2015

Michelle K. Lee

Michelle K. Lee
*Director of the United States Patent and Trademark Office*